US006976856B2

(12) United States Patent
Peng et al.

(10) Patent No.: US 6,976,856 B2
(45) Date of Patent: Dec. 20, 2005

(54) ELECTRONIC APPARATUS FOR REDUCING ELECTROMAGNETIC INTERFERENCE

(75) Inventors: Jung-Hsing Peng, Zhongli (TW); Li-Fu Sung, Sanchong (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 11/002,176

(22) Filed: Dec. 2, 2004

(65) Prior Publication Data

US 2005/0124208 A1 Jun. 9, 2005

(30) Foreign Application Priority Data

Dec. 4, 2003 (TW) ..... 92134181 A

(51) Int. Cl.[7] ..... H01R 13/648

(52) U.S. Cl. ..... 439/95; 439/92; 439/607

(58) Field of Search ..... 439/95, 92–94, 439/96–97, 607, 609

(56) References Cited

U.S. PATENT DOCUMENTS

| | | | | |
|---|---|---|---|---|
| 5,288,248 | A * | 2/1994 | Chen | 439/609 |
| 5,573,411 | A * | 11/1996 | Bartosz et al. | 439/95 |
| 5,913,698 | A * | 6/1999 | Keng | 439/609 |
| 6,109,966 | A * | 8/2000 | Chiou | 439/607 |
| 6,312,267 | B1 * | 11/2001 | Wang | 439/92 |

* cited by examiner

*Primary Examiner*—Hien Vu
*Assistant Examiner*—X. Chung-Trans
(74) *Attorney, Agent, or Firm*—Snell & Wilmer L.L.P.

(57) ABSTRACT

An electronic apparatus for reducing of EMI (Electromagnetic Interference) in an electronic device is provided. The apparatus includes a socket on a printed circuit board of the apparatus and a metal frame placed beside the printed circuit board for grounding purpose. The socket, inserted with a plug connecting to the electronic device, has at least one pin, and the pin is electronically connected to a conductive object on the printed circuit board. The metal frame has a first protrusion pressing against the conductive object, thereby allowing EMI of the electronic device to be grounded.

17 Claims, 3 Drawing Sheets

ELECTRONIC APPARATUS FOR REDUCING ELECTROMAGNETIC INTERFERENCE

CROSS-REFERENCE TO RELATED APPLICATIONS

This application claims priority based on Taiwan Patent Application No. 092134181 entitled "An Electronic Apparatus for the reduction of Electronic Magnetic Interference," filed on Dec. 4, 2003, which is incorporated herein by reference and assigned to the assignee herein.

FIELD OF INVENTION

The present invention relates to an electronic apparatus for reducing EMI (Electromagnetic Interference) of an electronic device, and more particularly, to such an electronic apparatus having a socket for the insertion of a plug electronically connected to the electronic device.

BACKGROUND OF THE INVENTION

Regarding the prevention of electronic devices from EMI, the most common idea is to figure out a way for conducting the EMI to the ground. There are mainly two types of the prior art technologies for carrying out such an idea. As to one of the types, the EMI of the device is first conducted to a printed circuit board of an electronic product, and then leaded by a predetermined path for grounding on the circuit of the board to electronically connect with a grounding system such as a screw hole. Following the engagement of the screw hole with a metal frame for grounding in the electronic product, the EMI of the device can be conducted to the ground. However, the path for grounding on the circuit is usually long and tortuous in order to accommodate others paths used for different functions in the electronic product, and therefore tends to cause the Antenna Effect. Besides, it might even induce more seriously double or triple EMI effects resulted from surrounding the path for grounding with so many sophisticated metal lines or other electronic components.

The other type of the prior art technology provides a metal-shelled plug connected with the grounding signal of the electronic device, wherein the EMI of the device can be grounded by directly setting the metal shell of the plug to contact with the metal frame devoid of passing through the printed circuit board of the electronic product. Although the metal-shelled plug improves the disadvantages of the aforementioned prior art, it still suffers from the higher cost due to the difficulty of manufacturing, particularly to those with complicated wire structures. For instance, as considering the cost, S Terminals with plastic shell are more popular than those with metal shell, even through the later has been invented for many years. Therefore, the aforementioned prior art is still adopted for reducing EMI within most of the electronic products.

Accordingly, there is a need to provide an electronic apparatus having advantages of shorting a grounding path without passing around such sophisticated circuit on the printed circuit board, disusing the more expensive metal-shelled plug for grounding, and effectively reducing the EMI of the electronic device as well.

SUMMARY OF THE INVENTION

The present invention provides an electronic apparatus for reducing EMI (Electromagnetic Interference) in an electronic device. The apparatus includes a socket on a printed circuit board of the apparatus and a metal frame placed beside the printed circuit board for grounding purpose. The socket, inserted with a plug connecting with the electronic device, has at least one pin, and the at least one pin is electronically connected to a conductive object on the printed circuit board. The metal frame has a first protrusion pressing against the conductive object so as to conduct the EMI of the electronic device to the ground.

DETAILED DESCRIPTION

Figure 1:
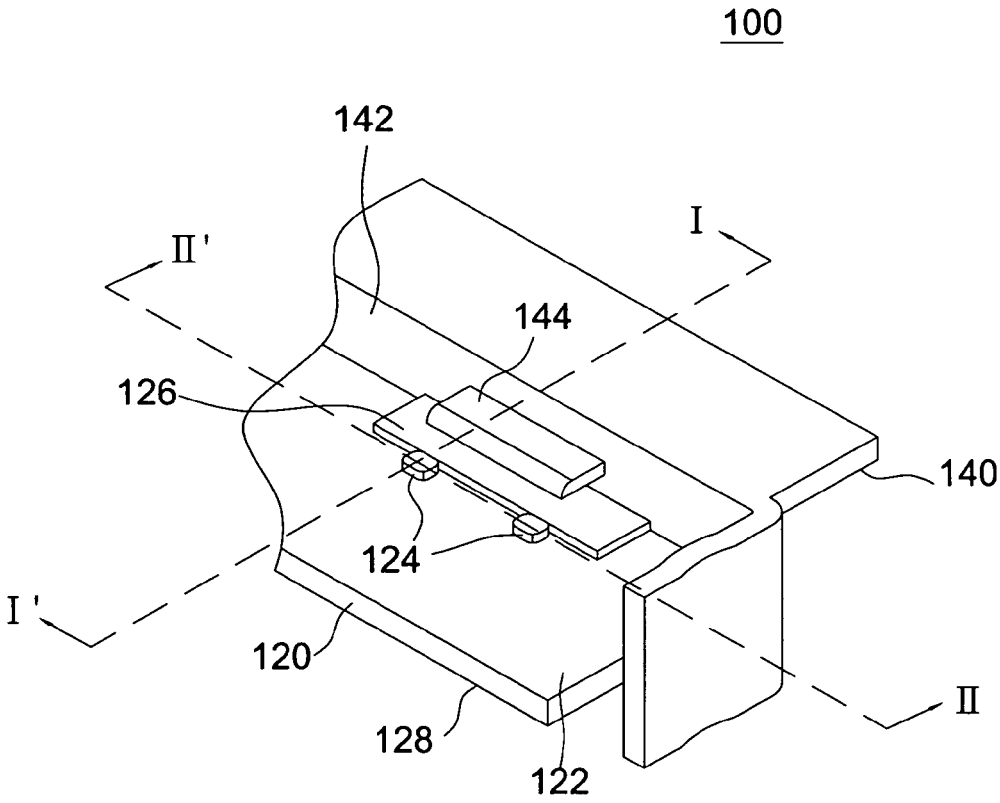
FIG. 1 is a partial perspective view of an electronic apparatus in accordance with the present invention.
Figure 2A:
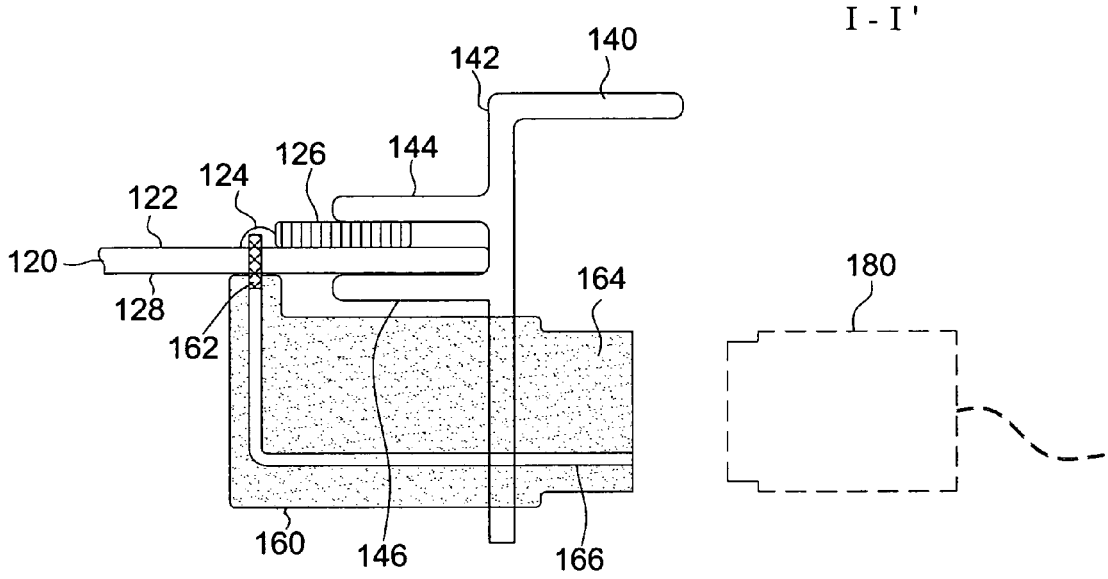
FIG. 2A is a sectional view taken alone line I—I' of FIG. 1.

The present invention provides an electronic apparatus for reducing EMI (Electromagnetic Interference). The electronic apparatus 100, as shown in FIG. 1, includes a printed circuit board 120 having a plurality of solder joints 124 and a conductive object located on the back surface 122 thereof, a metal frame 140 with a first protrusion 144 placed beside the printed circuit board 120. As shown in FIG. 2A, the electronic apparatus 100 still includes a socket 160 used for a plug 180. The socket 160, enclosed with a plastic shell and located on the front surface 128 of the printed circuit board, is configured as a plug-in and plug-out device for the plug 180, which is connected with any other kind of devices such as hard disks, memories, CPUs, monitors, printers or joysticks, etc. In one embodiment of the present invention, the plug 180 is, but not limited to, a kind of terminal including S-Terminals.

Figure 2B:
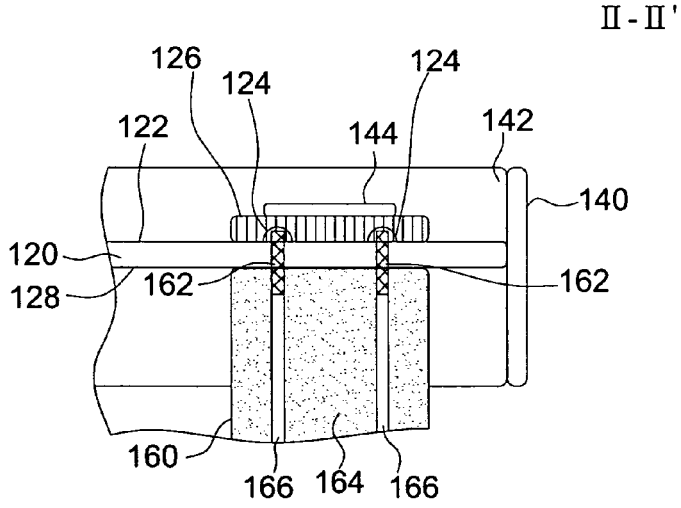
FIG. 2B is a sectional view taken alone line II—II' of FIG. 1.

Referring to FIG. 2A, a sectional view taken alone line I—I' of FIG. 1, the socket 160 further includes metal lines 166 inside, each of which is electronically connected with the corresponding one of pins 162 within the socket 160, to thereby enable the plug 180 to electronically connect with the pins 162 through the metal lines 166. As shown in FIG. 2A and FIG. 2B, each pin 162 has one end through the printed circuit board 120 and exposed to the back surface 122. In order to fix the pins 162 on the back surface 122, the solder joints 124 made of, for example, tin are formed to cover the exposed ends of the pins 162 on the back surface 122 of the printed circuit board. Moreover, the solder joints 124 are then set to contact with the conductive object 126 such that the pins 162 are electronically connected with the conductive object 126. Accordingly, the electronic connection as above-mentioned allows EMI to flow into the conductive object 126 from the electronic device. It should be noticed that the conductive object 126 is set to possess a relatively boarder surface area so as to decrease the density of the EMI effectively. Materials for the conductive object 126 can be selected from various metals or other conductive substances. In one embodiment of the present invention, the conductive object 126 is a layer of tin formed on the printed circuit board 120.

Further referring to FIG. 2A, the metal frame 140 placed beside the printed circuit board 120 is used not only for shielding the printed circuit board 120 from EMI as well known in the art, but also for conducting the EMI accumulated in the conductive object 126 to the ground. More specifically, the metal frame 140 possesses a first protrusion 144 and a second protrusion 146, both integrated into thereof. The protrusions 144 and 146 are located on a surface 142 of the metal frame 140 facing the printed circuit board 120. They are parallel and co-perpendicular to the surface 142. Accordingly, grounding the EMI in the conductive object 126 is achieved through an electronic connection formed by pressing the first protrusion 144 against the conductive object 126. Besides, through such pressing, the first protrusion 144 is also used with the second protrusion 144 together to sandwich the printed circuit board 120 as well.

In another embodiment of the present invention, the conductive object 126 can be placed on the back surface 128 of the printed circuit board 120 instead (not shown). In this situation, one end of the conduction object 126 is electronically connected with the pins 126 by, for example, vias of the printed circuit board 120 while the other end of the conduction object 126 is similarly pressed against the second protrusion 146. Thereby the EMI of the device is grounded. In this situation, the first protrusion 144 is merely for the purpose of sandwiching together the printed circuit board 120 with the second protrusion 146.

FIG. 2B, a sectional view taken alone line II—II' of FIG. 1, shows the socket 160 having two pins 162 according to an embodiment of the present invention. The number of the pins 162 is not intended to limit the scope of the present invention since it will vary with the devices connected to the plug 180 as well know by those skilled in the art.

Figure 3:
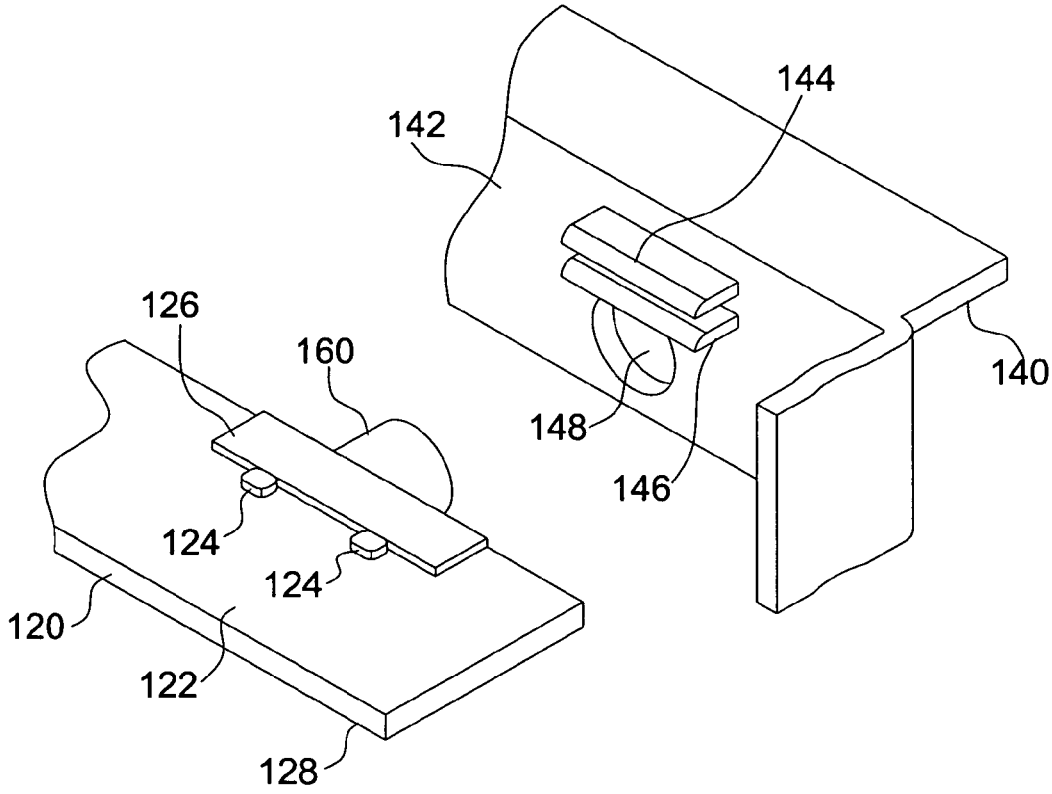
FIG. 3 is a partial perspective view showing the metal frame and the printed circuit board before assembling in accordance with the present invention.

FIG. 3 is a partial perspective view showing the metal frame 140 and the printed circuit board 120 before assembling in accordance with an embodiment of the present invention. As shown in FIG. 3, the surface 142 of the metal frame 144 further includes an opening 148 facing the socket 160 in addition to the protrusions 144 and 146 thereon. The opening 148 is used to wedge the socket 160 by assembling the metal frame 140 with the printed circuit board 120 following the way as above mentioned; that is, the socket 160 can pass through the metal frame 140 and be fitted as well within the opening 148. After such assembly, the opening 148 will be viewed as located above the first protrusion 144 by setting the front surface 128 of the printed circuit board 120 upward.

Accordingly, to reduce EMI of an electronic device using the apparatus 100 of the present invention is as simple as taking the plug 180 connected with the electronic device to insert into the socket 160. The EMI of the device will promptly flow into the conductive objective 126 then reach the ground by these electronic connections between the pins 162 of the plug 180, the conductive objective 126 of the printed circuit board 120, and the first protrusion 144 of the metal frame 140. Consequently, the electronic apparatus 100 of the present invention has the advantages of shorting the grounding path without passing around sophisticated circuits on the printed circuit board as well as disusing the metal-shelled plug for grounding, and therefore the problems in the prior arts are resolved.

The present invention has been described above with reference to preferred embodiments. However, those skilled in the art will understand that the scope of the present invention need not be limited to the disclosed preferred embodiments. On the contrary, it is intended to cover various modifications and equivalent arrangements within the scope defined in the following appended claims. The scope of the claims should be accorded the broadest interpretation so as to encompass all such modifications and equivalent arrangements.

We claim:

1. An electronic apparatus for reducing Electromagnetic Interference (EMI), comprising:

a printed circuit board;

a socket, located on said printed circuit board and having at least one pin;

a conductive object, located on said printed circuit board and electronically connected with said at least one pin; and a metal frame, placed beside said printed circuit board and having a first protrusion pressed against said conductive object, wherein said metal frame shields said printed circuit board from EMI, wherein said socket receives a plug for conducting a grounding signal of an electronic device, and said plug is electronically connected with said at least one pin and further electronically connected with said metal frame through said at least one pin and said conductive object, thereby conducting EMI from the electronic device to the ground by said metal frame.

2. The apparatus of claim 1, wherein said plug is an S-Terminal.

3. The apparatus of claim 1, wherein said conductive object is made of tin.

4. The apparatus of claim 1, wherein said metal frame has a surface facing said socket, said surface being formed with an opening used for coupling with said socket.

5. The apparatus of claim 4, wherein said opening is located above said first protrusion and formed in said metal frame.

6. The apparatus of claim 1, wherein said metal frame has a second protrusion for use with said first protrusion together to said printed circuit board.

7. The apparatus of claim 6, wherein said first protrusion and said second protrusion are parallel and integrated into said metal frame.

8. An electronic apparatus for reducing Electromagnetic Interference (EMI), comprising:

a printed circuit board;

a socket, located on said printed circuit board and having at least one pin;

a conductive object, located on said printed circuit board and electronically connected with said at least one pin; and a metal frame, placed beside said printed circuit board and having a first protrusion pressed against said conductive object, wherein said metal frame shields said printed circuit board from EMI, wherein said socket receives an S-Terminal of an electronic device, and said S-Terminal is electronically connected with said at least one pin and further electronically connected with said metal frame through said at least one pin and said conductive object, thereby conducting EMI to the ground by said metal frame.

9. The apparatus of claim 8, wherein said conductive object is made of tin.

10. The apparatus of claim 8, wherein said metal frame has a surface facing said socket, said surface being formed with an opening used for coupling with said socket.

11. The apparatus of claim 10, wherein said opening is located above said first protrusion and formed in said metal frame.

12. The apparatus of claim 8, wherein said metal frame has a second protrusion for use with said first protrusion together to sandwich said printed circuit board.

13. The apparatus of claim 12, wherein said first protrusion and said second protrusion are parallel and integrated into said metal frame.

14. An electronic apparatus for reducing Electromagnetic Interference (EMI), comprising:

a printed circuit board;

a socket, located on said printed circuit board and having at least one pin;

a conductive object, located on said printed circuit board and electronically connected with said at least one pin; and a metal frame, placed beside said printed circuit board, said metal frame having a first protrusion pressed against said conductive object and a surface facing said socket, said surface including an opening used for coupling with said socket, wherein said metal frame shields said printed circuit board from EMI, wherein said socket receives an S-Terminal of an electronic device, and said S-Terminal is electronically connected with said at least one pin and further electronically connected with said metal frame through said at least one pin and said conductive object, thereby conducting EMI to the ground by said metal frame.

15. The apparatus of claim 14, wherein said opening is located above said first protrusion and formed in said metal frame.

16. The apparatus of claim 14, wherein said metal frame has a second protrusion for use with said first protrusion together to sandwich said printed circuit board.

17. The apparatus of claim 16, wherein said first protrusion and said second protrusion are parallel and integrated into said metal frame.

* * * * *